US005697017A

United States Patent [19]

Rooke et al.

[11] Patent Number: 5,697,017

[45] Date of Patent: Dec. 9, 1997

[54] IMAGE FORMING APPARATUS HAVING PROCESS CARTRIDGE WITH SHUTTER AND CLEANING MEMBER

[75] Inventors: Paul Allen Rooke, Lexington; Thomas Howard Miller, Georgetown; John Edward Passafiume, Lexington, all of Ky.; Narutaka Yoshida, Toyokawa, Japan; Yasushi Tsuda, Toyokawa, Japan; Joho Katsuo, Toyohashi, Japan; Hirofumi Hasegawa, Toyokawa, Japan

[73] Assignees: Lexmark International, Inc., Lexington, Ky.; Minolta Co., Ltd., Osaka, Japan

[21] Appl. No.: 568,665

[22] Filed: Dec. 7, 1995

[51] Int. Cl.[6] ..... G03G 15/00

[52] U.S. Cl. ..... 399/71; 399/114

[58] Field of Search ..... 399/113, 114, 399/149, 150, 350, 71

[56] References Cited

U.S. PATENT DOCUMENTS

| | | | |
|---|---|---|---|
| Re. 34,840 | 1/1995 | Yamaguchi et al. . | |
| 4,924,267 | 5/1990 | Yoshikawa et al. | 399/112 |
| 5,113,220 | 5/1992 | Kwak | 399/114 |
| 5,202,728 | 4/1993 | Maeshima et al. | 399/114 |
| 5,220,386 | 6/1993 | Aoki et al. | 399/71 |
| 5,266,999 | 11/1993 | Yashiro | 399/114 |

FOREIGN PATENT DOCUMENTS

| | | |
|---|---|---|
| 3-7972 | 1/1991 | Japan . |
| 5-273849 | 10/1993 | Japan . |

*Primary Examiner*—Robert Beatty

*Attorney, Agent, or Firm*—Burns, Doane, Swecker & Mathis, LLP

[57] ABSTRACT

An image forming apparatus includes a photosensitive member, a developing unit which is removably installed in a body of the image forming apparatus, a shutter covering a developing region of the photosensitive member when the developing unit is removed from the body of the image forming apparatus and a cleaning member capable of cleaning the surface of the photosensitive member in accordance with rotation of the photosensitive member by making contact with the photosensitive member in conjunction with the shutter covering operation, but which does not contact the photosensitive member when the shutter is open. During a control operation, foreign matter such as used developer adhered to the photosensitive member is removed when the photosensitive member is rotated with the shutter closed.

24 Claims, 12 Drawing Sheets

IMAGE FORMING APPARATUS HAVING PROCESS CARTRIDGE WITH SHUTTER AND CLEANING MEMBER

BACKGROUND OF THE INVENTION

1. Field of the Invention

The present invention relates to an image forming apparatus, and specifically relates to an image forming apparatus for electrophotography wherein an image is optically exposed on a photosensitive member, developed by a developer, and transferred to a sheet. More specifically, the present invention relates to cleaning residual and unwanted foreign matter such as developer and the like from the surface of the photosensitive member.

2. Description of the Related Art

Conventional image forming apparatus of the electrophotographic type generally have been provided with image forming elements and a cleaning unit, and have cleaning processes within the image forming process.

In every image forming process, residual toner is removed from the surface of the photosensitive member by the cleaning unit, and becomes waste toner. Furthermore, layer shaving of the photosensitive member is accelerated through the normal contact of the cleaning member with the photosensitive member during the image forming process. On the other hand, recycling and ecology movements have flourished in recent years. The cleaning unit has become an important factor that increases the complexity the apparatus as well as its size as demand has increased for compact printers.

Image forming apparatus which address the aforesaid issues are disclosed in Japanese Unexamined Patent Application No. HEI 5-273849 and U.S. Pat. No. 5,051,332. These apparatuses remove the independent cleaning process from the image forming process, and provide the developing device with a cleaning function. These apparatuses reuse the residual toner collected by the developing device via its cleaning function by collecting said residual toner within the developing device.

The aforesaid apparatuses also have limits. That is, these apparatuses are disadvantageous inasmuch as they cannot maintain the cleaning power of a conventional independent cleaning member. Over long term use, these apparatuses are incapable of complete cleaning of residual toner and other foreign matter adhered to the photosensitive member. This situation results in black spots and non-developing white spots in the produced images.

OBJECTS AND SUMMARY

An object of the present invention is to eliminate the previously described disadvantages.

Another object of the present invention is to assure the quality of produced images by providing an excellent cleaning device.

A further object of the present invention is to provide a cleaning device capable of reliably cleaning residual foreign matter remaining on the surface of a photosensitive member.

A still further object of the present invention is to provide a cleaning device capable of reliably cleaning residual foreign matter remaining on the surface of a photosensitive member, and suppressing layer shaving of the photosensitive member.

An even further object of the present invention is to avoid increasing the cost and size of the overall image forming apparatus by elimination of a large and complex cleaning device.

These and other objects are attained by providing an image forming apparatus having a photosensitive member, a shutter covering a predetermined region of said photosensitive member during non-image forming time, and a cleaning member capable of cleaning the surface of the photosensitive member in accordance with the rotation of said photosensitive member by making contact with the photosensitive member in conjunction with the shutter covering operation but which does not contact the photosensitive member when said shutter is open.

These and other objects of the present invention are described below with reference to the accompanying drawings.

BRIEF DESCRIPTION OF THE DRAWINGS

These and other objects and features of the present invention will become apparent from the following description of the preferred embodiments thereof taken in conjunction with the accompanying drawings, in which.

In the following description, like parts are designated by like reference numbers throughout the several drawings.

DETAILED DESCRIPTION OF THE PREFERRED EMBODIMENTS

The preferred embodiments of the image forming apparatus of the present invention are described hereinafter with reference to the accompanying drawings. The following embodiments portray an example of the image forming apparatus of the present invention adapted for a laser printer.

Figure 1:
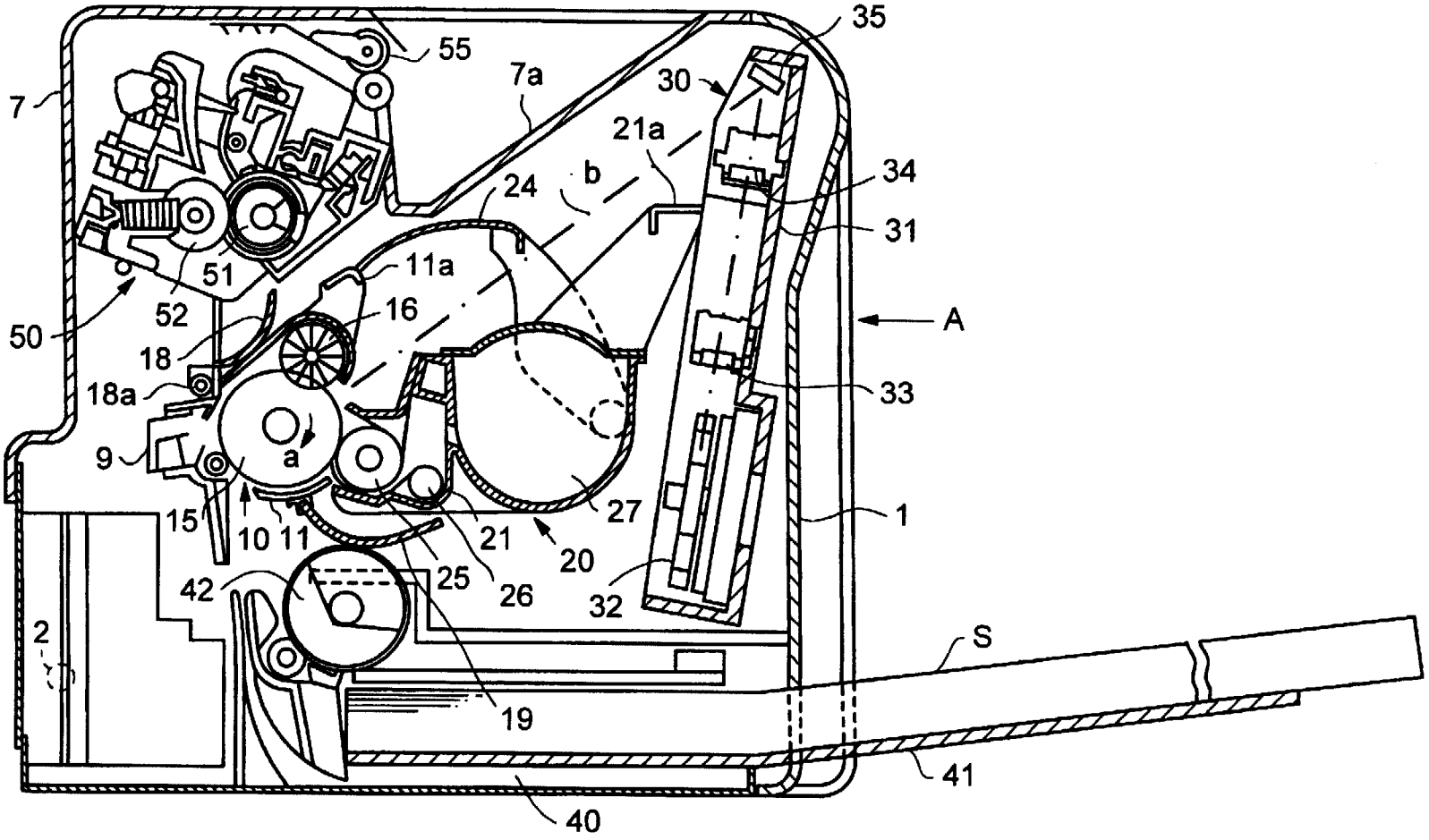
FIG. 1 is a section view of the interior construction of printer of the present invention.

FIG. 1 is a section view of a laser printer. Reference number 10 refers to the photosensitive member unit, and reference number 20 refers to a developing unit; these units are constructed so as to be removably installed in the printer body. Reference number 30 refers to an optical unit which emits and deflects a laser beam modulated in accordance with image signals input from an external device. The printer is also provided with a paper supply section 40, fixing section 50, and discharge tray 7*a*.

The printer is covered by a stationary frame 1 and a movable frame 7. Movable frame 7 is rotatable about a rotating shaft 2 provided on stationary frame 1. An operator positioned on the front side of the apparatus as indicated by the A position in the drawing removes jammed paper, and replaces photosensitive member unit 10 and developing unit 20 by opening the aforesaid movable frame 7.

Photosensitive member unit 10 houses within a casing 11 a photosensitive drum 15 that is rotatable in the arrow a direction in the drawing, and a charging brush 16 for charging the surface of said photosensitive drum 15. Developing unit 20 has within a casing 21 a developing sleeve 25, mixing roller 26, and toner tank 27. The toner in toner tank 27 is mixed with a carrier via mixing roller 26, and thereafter supplied to developing sleeve 25.

Optical unit 30 generates a modulated laser beam, and deflects said beam using a polygonal mirror 32. As a result, laser beam b emitted from optical unit 30 is deflects so as to scan the surface of photosensitive drum 15. Optical unit 30 has a conventional and well known construction, and, therefore, is not described in detail in the following discussion.

Paper fed upward from paper supply section 40 receives an image transferred from photosensitive drum 15 at the transfer region of photosensitive member unit 10, and continues upward. After the transferred image has been fixed onto the paper by fixing section 50, the paper is ejected to discharge tray 7*a*. Paper supply section 40, fixing section 50, and optical exposure, developing, and transfer processes of the image forming process accomplished in the laser printer are similar to well known units and processes, and, therefore, are not described in detail in the following discussion.

The installation and removal of photosensitive member unit 10 and developing unit 20 are described below.

Figure 6:
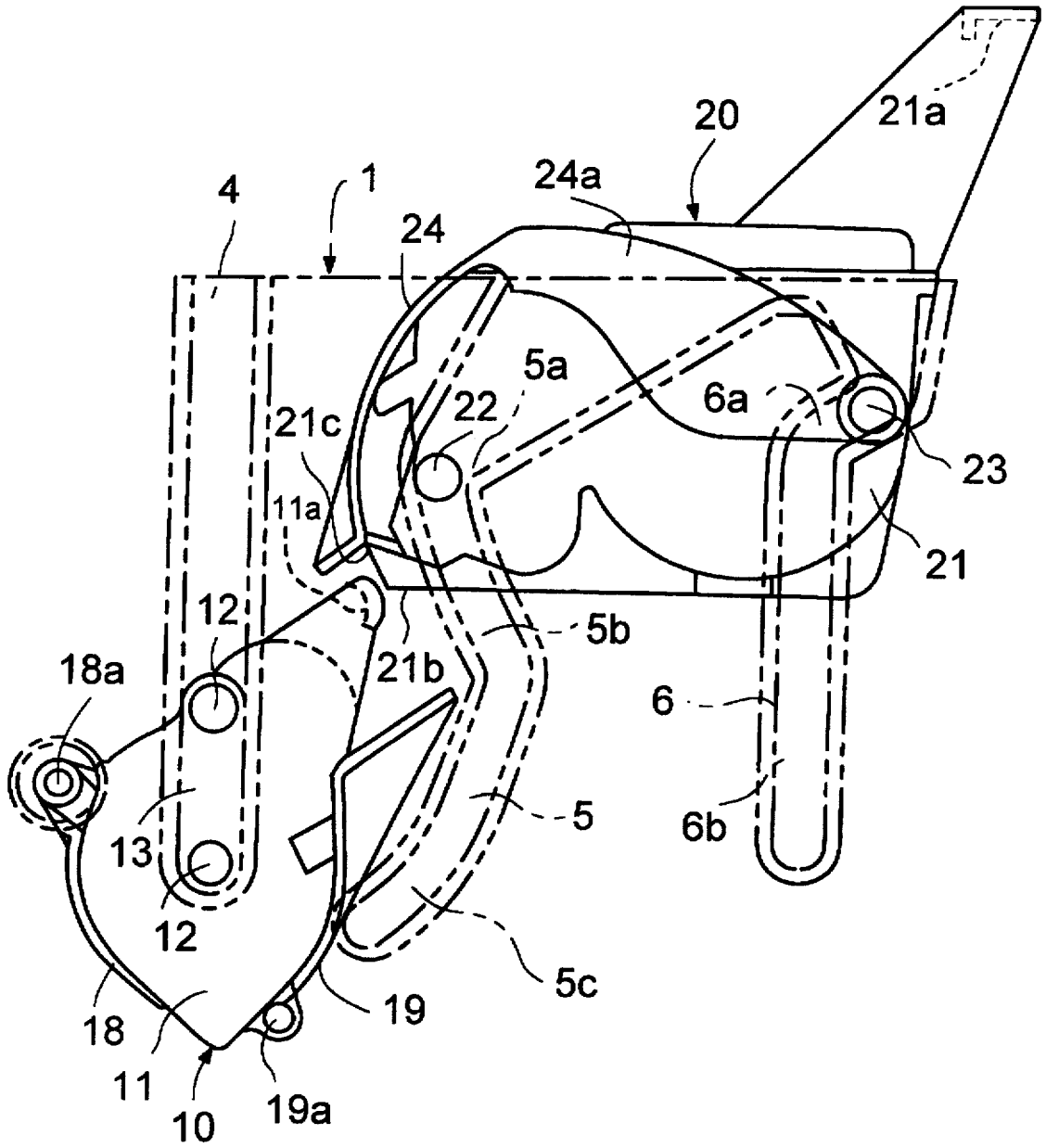
FIG. 6 illustrates the developing unit installation operation and the shutter operating mechanism.

As shown in FIG. 6, photosensitive member unit 10 is installed and removed by moving frame 13 vertically within guide channel 4 formed on bilateral side walls of stationary frame 1, said frame 13 being attached to both sides of casing 11 via pins 12. Reference number 11*a* refers to a handle provided on casing 11 for installation and removal. Guide channel 4 is formed in a perpendicular direction, photosensitive member unit 10 is set at a predetermined position when frame 13 arrives at the bottom of guide channel 4.

Developing unit 20 has two pairs of guide pin 22 and 23 provided bilaterally on casing 21. Guide pins 22 and 23 are installed and removed by vertical movement within guide channels 5 and 6 formed in the bilateral walls of stationary frame 1. Reference number 21*a* refers to a handle provided on casing 21 for said installation and removal.

Guide channel 5 comprises an inlet 5*a*, a first oblique portion 5*b*, and a second oblique portion 5*c*. Guide channel 6 comprises an inlet 6*a*, and perpendicular portion 6*b* extending from said inlet 6*a* somewhat into the interior in a perpendicular direction.

Figure 7:
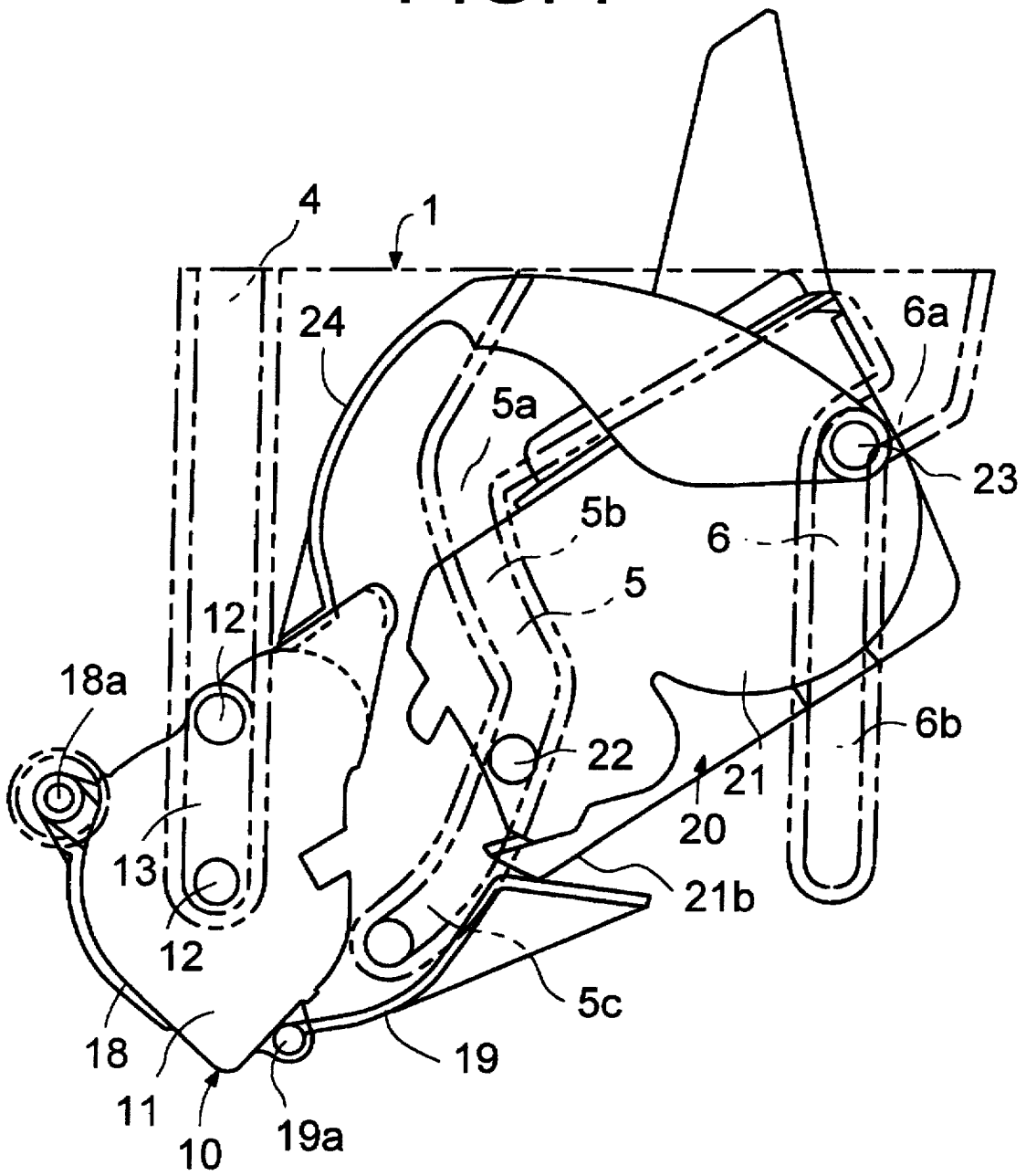
FIG. 7 illustrates the developing unit installation operation and the shutter operating mechanism.

When developing unit 20 is installed in the apparatus body, guide pins 22 and 23 are respectively position at inlets 5*a* and 6*a* of guide channels 5 and 6. Then, guide pin 23 pivots so as to move downward into casing 21. At this time, guide pin 22 moves downward while being guided by first oblique portion 5*b*. Guide pin 22 transits the contiguous oblique portions 5*b* and 5*c*, and developing unit 20 enters the second oblique portion 5*c* of its own weight. Guide pins 23 moves from inlet 6*a* to perpendicular portion 6*b* by means of the aforesaid operation (refer to FIG. 7).

Figure 8:
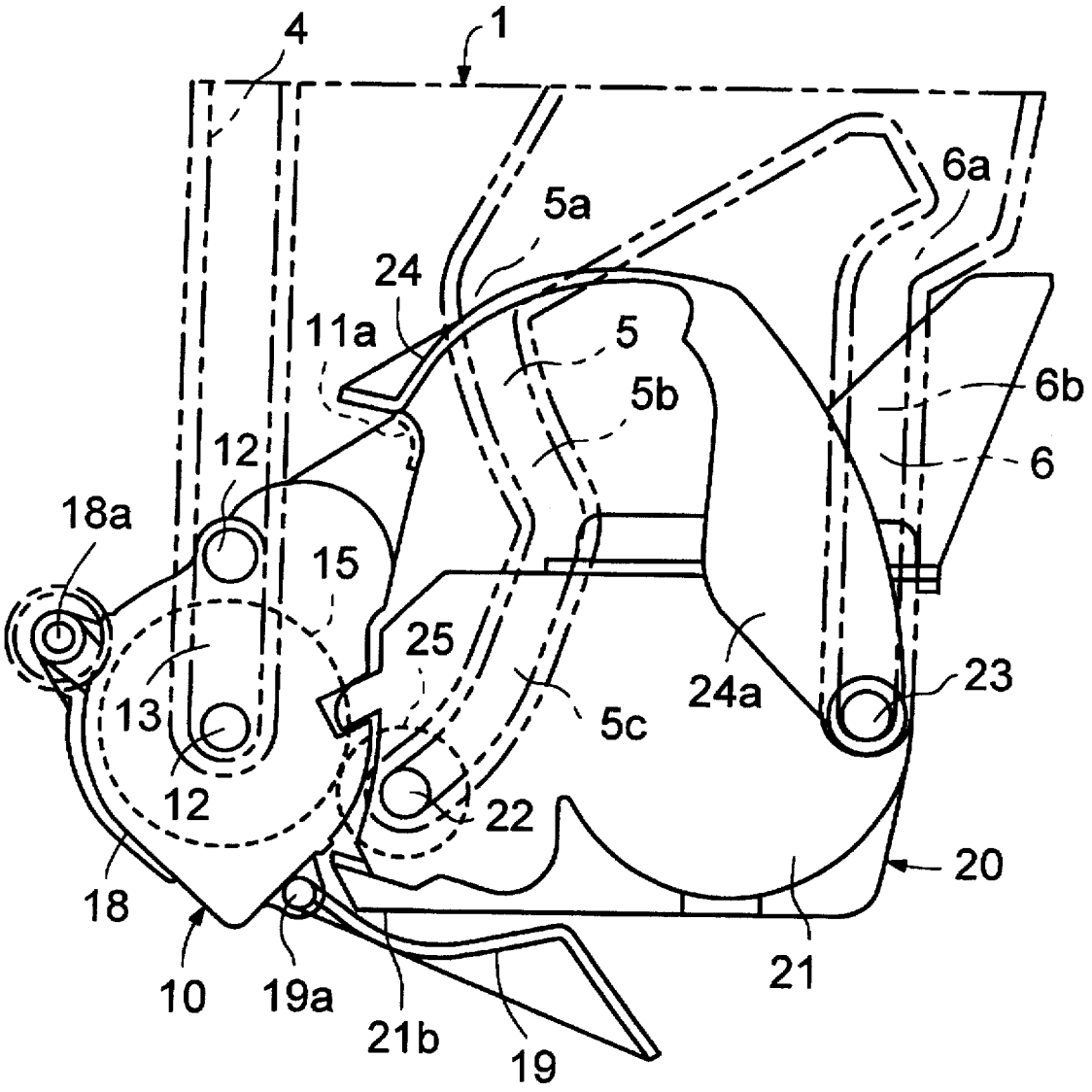
FIG. 8 illustrates the developing unit installation operation and the shutter operating mechanism.

Thereafter, when an operator loosens the force holding the developing unit 20, guide pin 22 moves downward in second oblique portion 5*c* and at the same time guide pin 23 moves downward in perpendicular portion 6*b*, until each pin 22 and 23 reaches the bottom of the respective guide channels 5 and 6. Thus, developing unit 20 is set at a predetermined position (refer to FIG. 8).

The construction of photosensitive member unit 10, and the shutter provided on developing unit 20, as well as the operation of the shutter in conjunction with the installation/removal of each unit are described hereinafter.

Photosensitive member unit 10 and developing unit 20 are both provided with a shutter capable of opening and closing as a part of their respective casings. These shutters are used to protect and cover photosensitive member unit 10 and developing unit 20 when the respective units are removed from the printer and when movable frame 7 is open.

Figure 2:
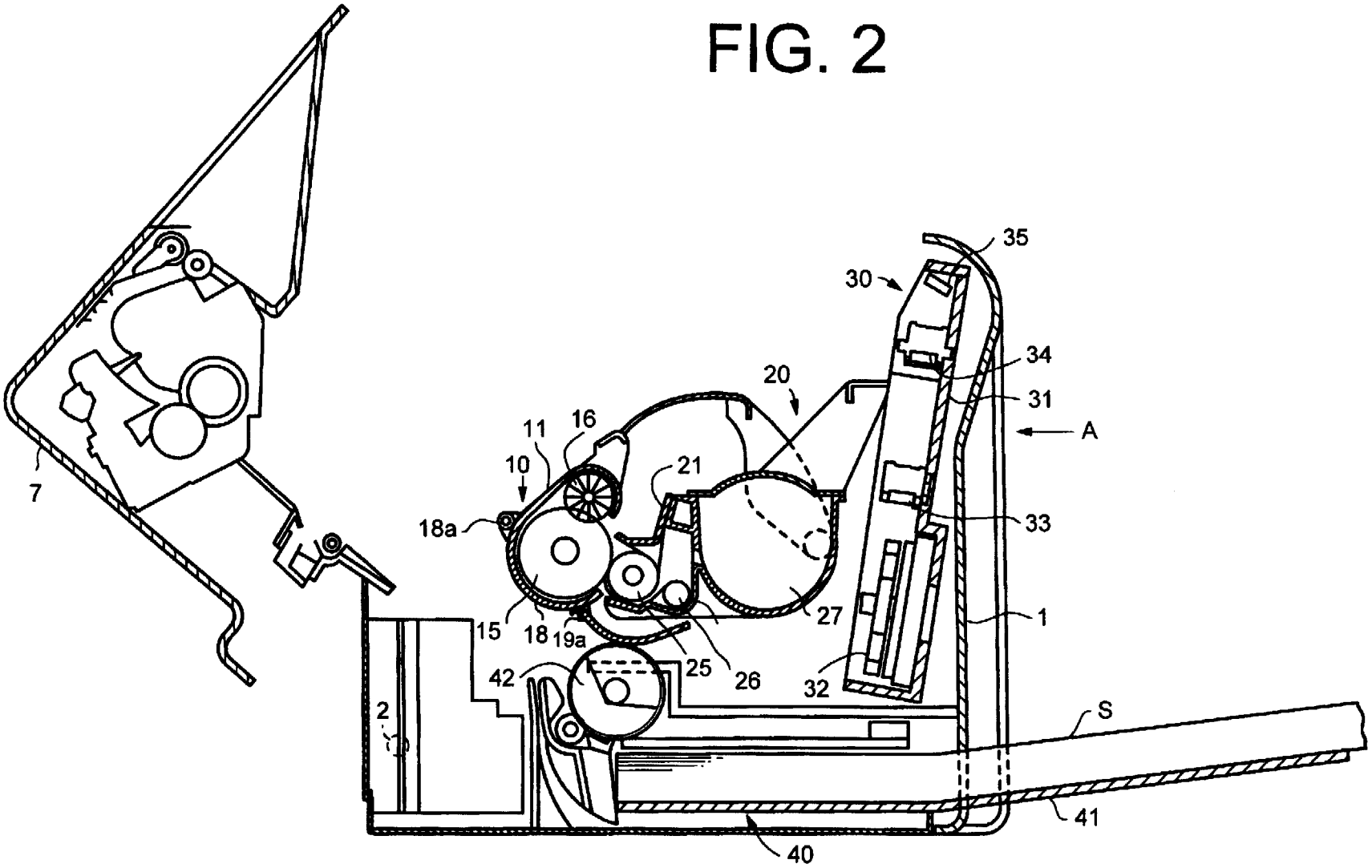
FIG. 2 is a section view showing the printer body in an open state.
Figure 3:
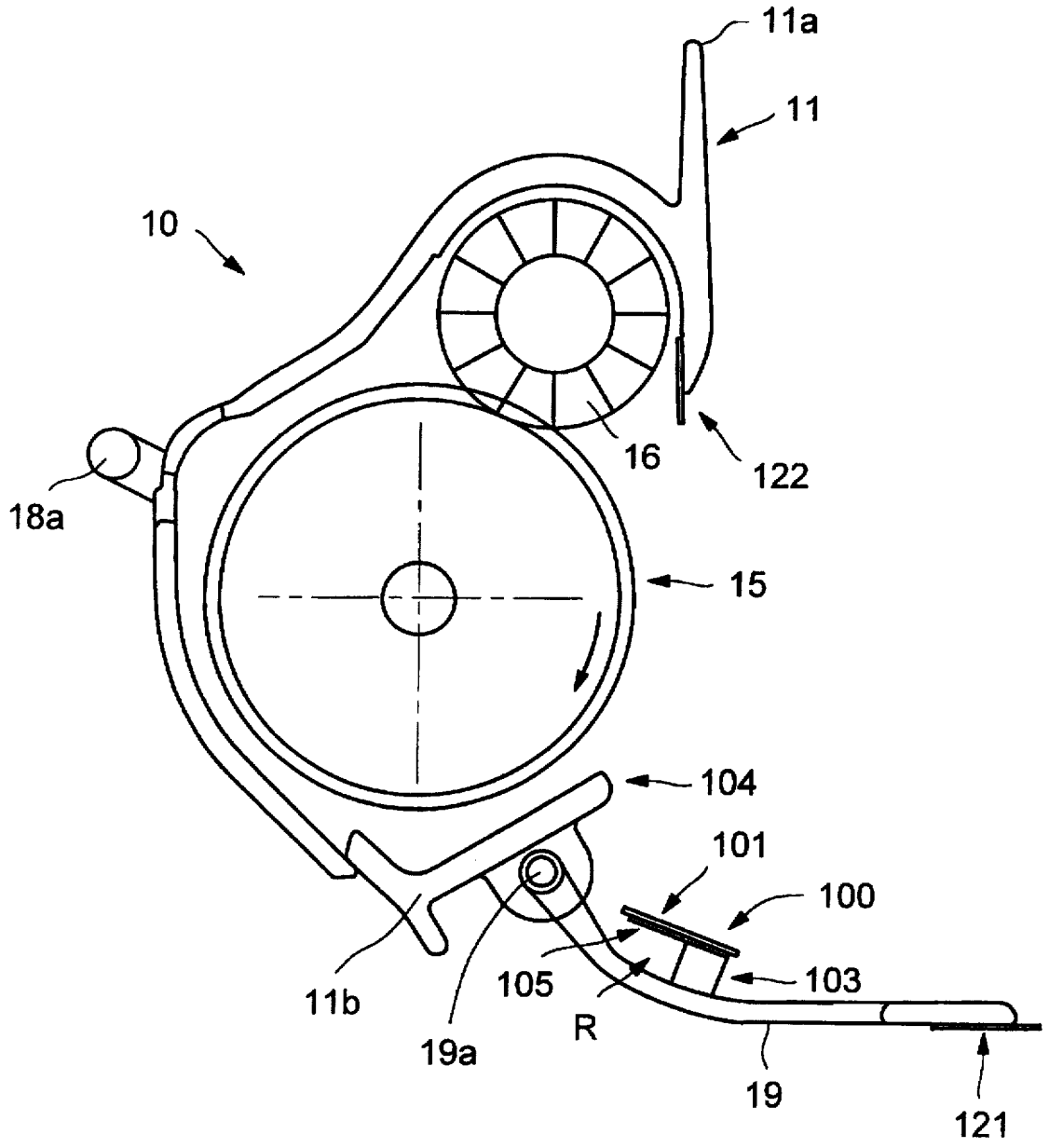
FIG. 3 is a section view of the photosensitive member unit with the second shutter in an open state.

Photosensitive member unit 10 is provided with a first shutter 18 and a second shutter 19 as parts of casing 11, as shown in FIGS. 1, 2, and 3. First shutter 18 is rotatably mounted on a pin 18*a* attached to casing 11, and is normally forced in a counterclockwise direction by a tension spring not shown in the drawings. When photosensitive member unit 10 is removed from the printer body, and when the top portion of the printer body (i.e., movable frame 7) is opened, the first shutter 18 is rotated by the spring force f the aforesaid tension spring so as to cover the interior side, i.e., the transfer region, of photosensitive drum 15. On the other hand, when movable frame 7 is closed, a projection (not illustrated) provided on said movable frame 7 pushes the first shutter 18. As a result, first shutter 18 pivots on pin 18*a* and moves in a clockwise direction so as to open the transfer region of photosensitive drum 15 (refer to FIG. 1).

Figure 4:
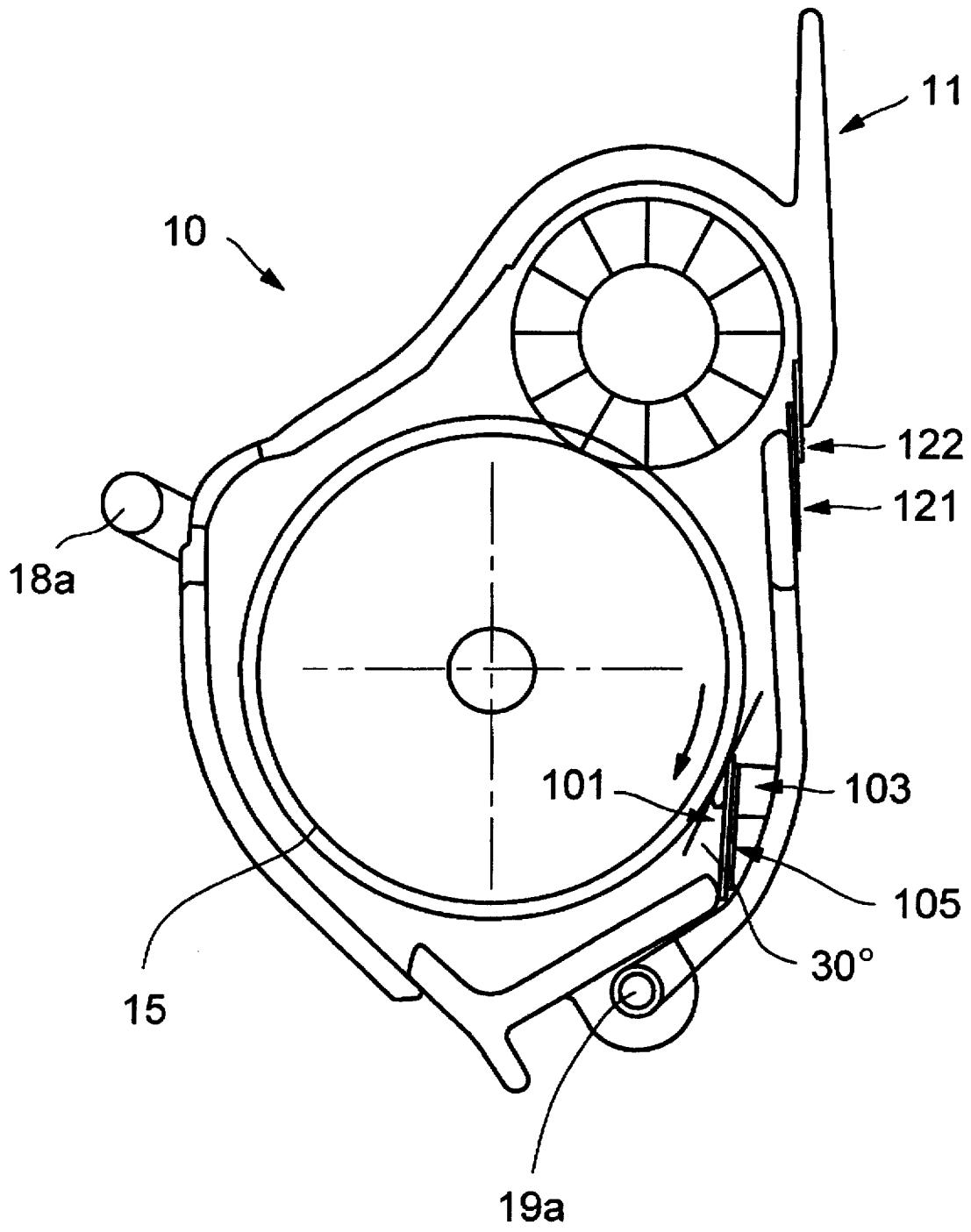
FIG. 4 is a section view of the photosensitive member unit with the second shutter in a closed state.

Second shutter 19 is rotatably provided on pin 19*a* attached to casing 11, and is normally forced in a counterclockwise direction by a tension spring not shown in the drawing. When developing unit 20 is removed from the printer body, second shutter 19 covers the developing region of photosensitive drum 15 by means of a spring force exerted by the aforesaid tension spring. That is, as shown in FIG. 4, second shutter 19 protects and covers the developing region of photosensitive drum 15 before installation of developing unit 20. When developing unit 20 is installed on stationary frame 1 along guide channels 5 and 6, angle portion 21*b* of casing 21 pushes second shutter 19 downward. As a result, second shutter 19 pivots on pin 19*a* and rotates in a clockwise direction so as to open the developing region of photosensitive drum 15 (refer to FIG. 3).

Figure 5:
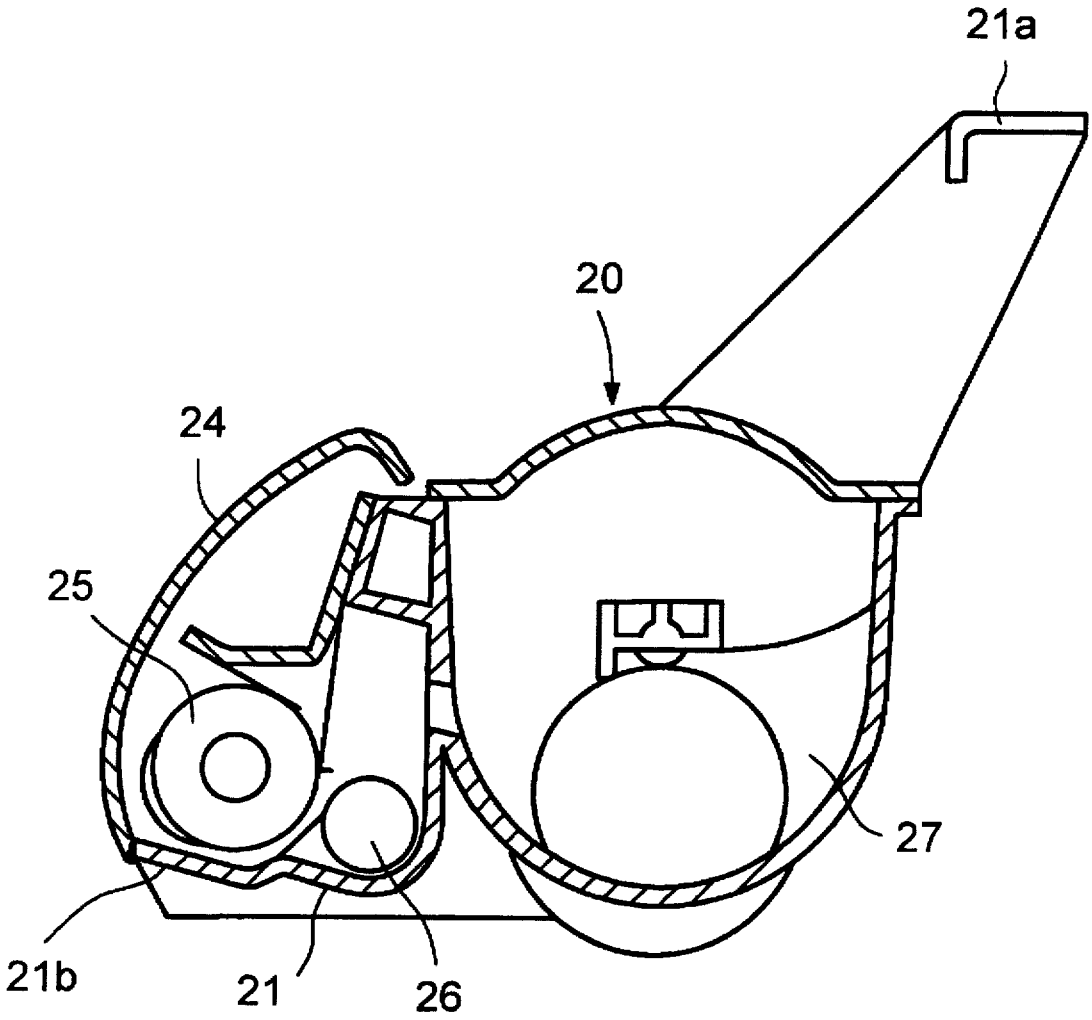
FIG. 5 is a section view of the developing unit.

On the other hand, developing unit 20 is provided with a shutter 24 as part of casing 21. When developing unit 20 is removed from the printer body, shutter 24 protects and covers developing sleeve 25 of developing unit 20 (refer to FIG. 5). Shutter 24 is rotated upward by handle 11*a* of photosensitive member unit 10 in conjunction with the installation of developing unit 20 in the printer body, so as to open developing sleeve 25.

Scraper 100 of the present invention is described hereinafter.

Scraper 100 is provided on the interior wall of second shutter 19 of photosensitive member unit 10, and is arranged so as to be in contact with the surface of photosensitive drum 15 when second shutter 19 is closed. The contact angle is desirably about 30° relative to a tangential direction with the surface of photosensitive drum 15.

Scraper 100 comprises a flexible member 103 attached to the interior wall of second shutter 19, thin stainless steel plate 105 and attached to the top of flexible member 103, and a thin resin film 101 attached to the top of thin plate 105. In the present embodiment, the flexible member 103, thin plate 105, and thin film 101 are formed of the materials described below.

Flexible member: molto pren NHK Spring Co., Ltd. Super Sheet—(urethane foam)

Thin plate: SUS 301-CSP-1/2H (stainless steel)

Thin resin film: Lumilar (PET film; 188 μm) Toray K.K.

These materials may be substituted by other materials having similar characteristics and functions.

Scraper 100 has at least a length capable of cleaning the image forming region on the surface of photosensitive drum 15 with respect to the rotational axis direction (lengthwise direction) of said photosensitive drum 15. In the rotational axis direction of photosensitive drum 15, the total surface of thin plate 105 and thin film 101 are supported by flexible member 103. That is, thin plate 105, thin film 101, and flexible member 103 have identical lengths in the lengthwise direction of photosensitive drum 15. As shown in FIGS. 3 and 4, however, thin film 101 and thin plate 105 are supported by flexible member 103 only in the vicinity in contact with photosensitive drum 15 in the rotational direction of said photosensitive drum 15, whereas their other ends are free.

Accordingly, when shutter 19 is not closed, i.e., when scraper 100 is not in contact with photosensitive drum 15, a gap R is formed a the aforesaid free end, as shown in FIG. 3.

When an image forming operation is not occurring, i.e., when developing unit 20 is removed from the printer body, second shutter 19 is rotated in a direction to cover photosensitive drum 15 by the spring force of the tension spring. In accordance with this operation, pushing member 104 provided at the leading edge of support member **11*b* pushes the free end of scraper 100 in a direction to reduce the aforesaid gap R. The result of the free end of scraper 100 being pushed by push member 104 is that flexible member 105 is deformed such that the contact side is elevated toward photosensitive drum 15, and thin film 101 and thin plate 105 are somewhat inclined relative to flexible member 103. Thus, the pressure force is increased at the contact portion, and the cleaning force is increased. That is, thin film 101 and thin plate 105 are supported so as to form the aforesaid gap R for the purpose of easily deforming flexible member 103**.

In the present embodiment, lock members 121 and 122 are provided to prevent second shutter 19 from easily opening after it has been closed due to the weight of the shutter and the load applied by the rotation of photosensitive drum 15. Locks 121 and 122 are films respectively attached to second shutter 19 and casing 11. Although a 188 μm Lumilar (PET film; Toray K.K.), is used as the film in the present embodiment, the present invention is not limited to this material.

Lock 121 locks second shutter 19 by it insertion in the interior side of lock 122. The leading edge of scraper 100 increases the pressure of the contact with photosensitive drum 15 via the aforesaid locking. Furthermore the locking mechanism allows contact of the leading edge of scraper 100 with the photosensitive drum 15 with a uniform force in the lengthwise direction of the photosensitive drum 15 so as to obtain stable cleaning power.

In the photosensitive member unit 10 of the previously described construction, when an image forming operation is possible, i.e., when second shutter 19 is opened and developing unit 20 is installed, scraper 100 is in a state of contact with the bottom surface of developing unit 20 and is not in contact with photosensitive drum 15. When the image forming operation continues for a long time in this state and under conditions of high humidity, there is concern that thin film 101 by become deformed along the bottom surface of developing unit 20. In the present invention, however, deformation of thin film 101 is prevented by the provision of thin plate 105. Furthermore, the springiness of thin plate 105 is effective in preventing undulation of thin film 101 generated at the start of the cleaning operation.

Figure 9:
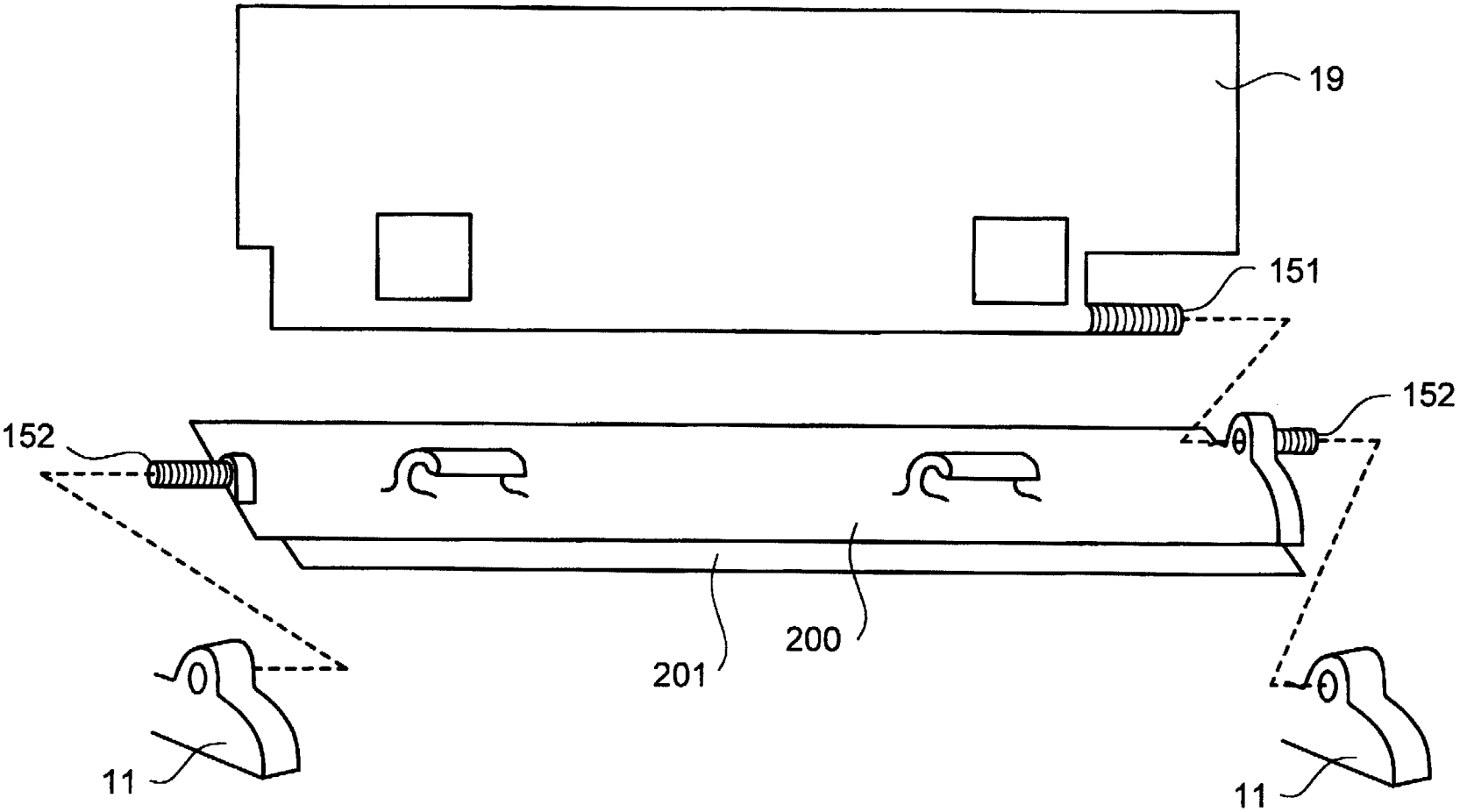
FIG. 9 is a perspective view of the cleaning member and shutter mechanism of a second embodiment.
Figure 10:
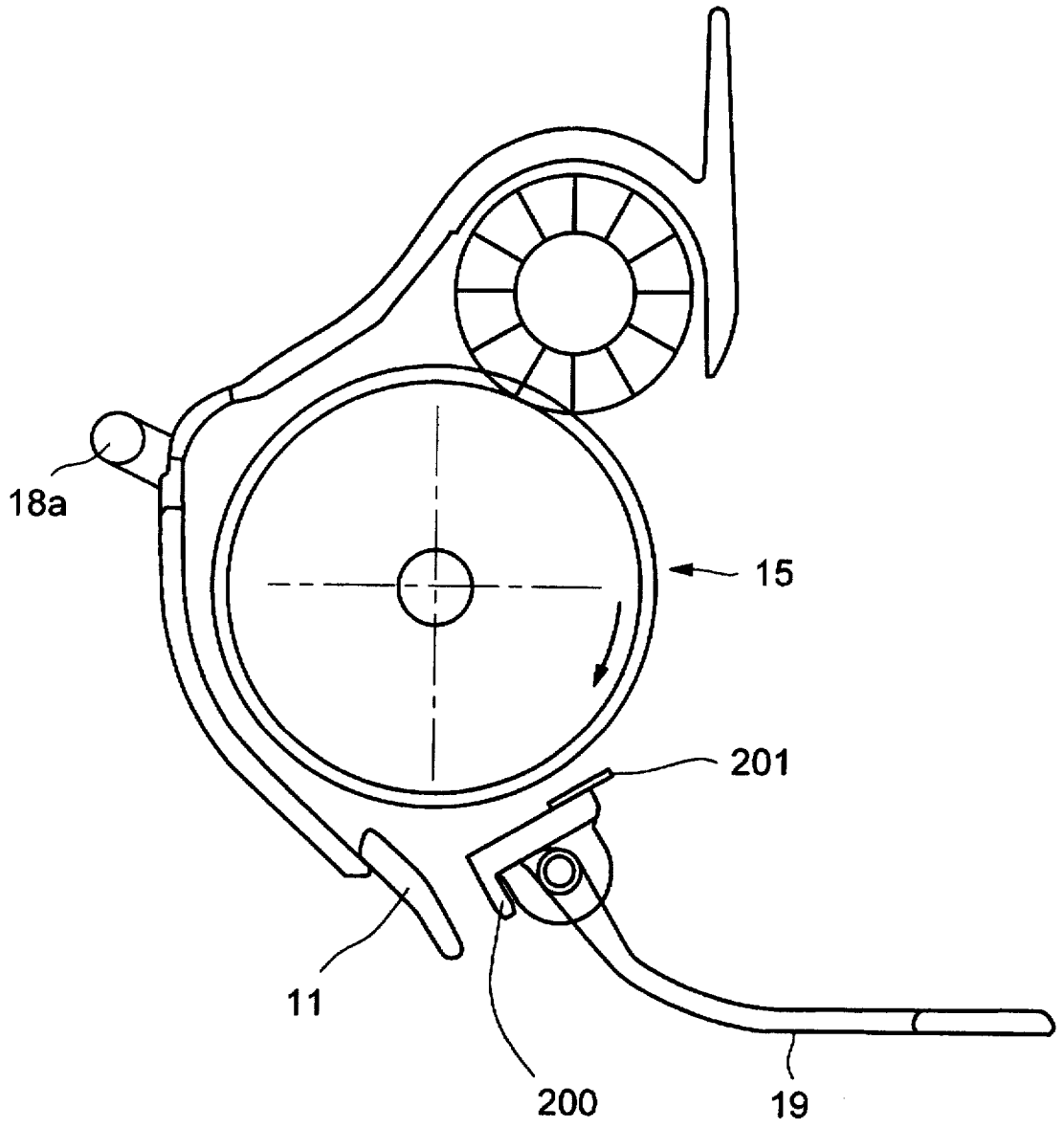
FIG. 10 is a section view of the photosensitive member unit with the shutter in an open state in a second embodiment.
Figure 11:
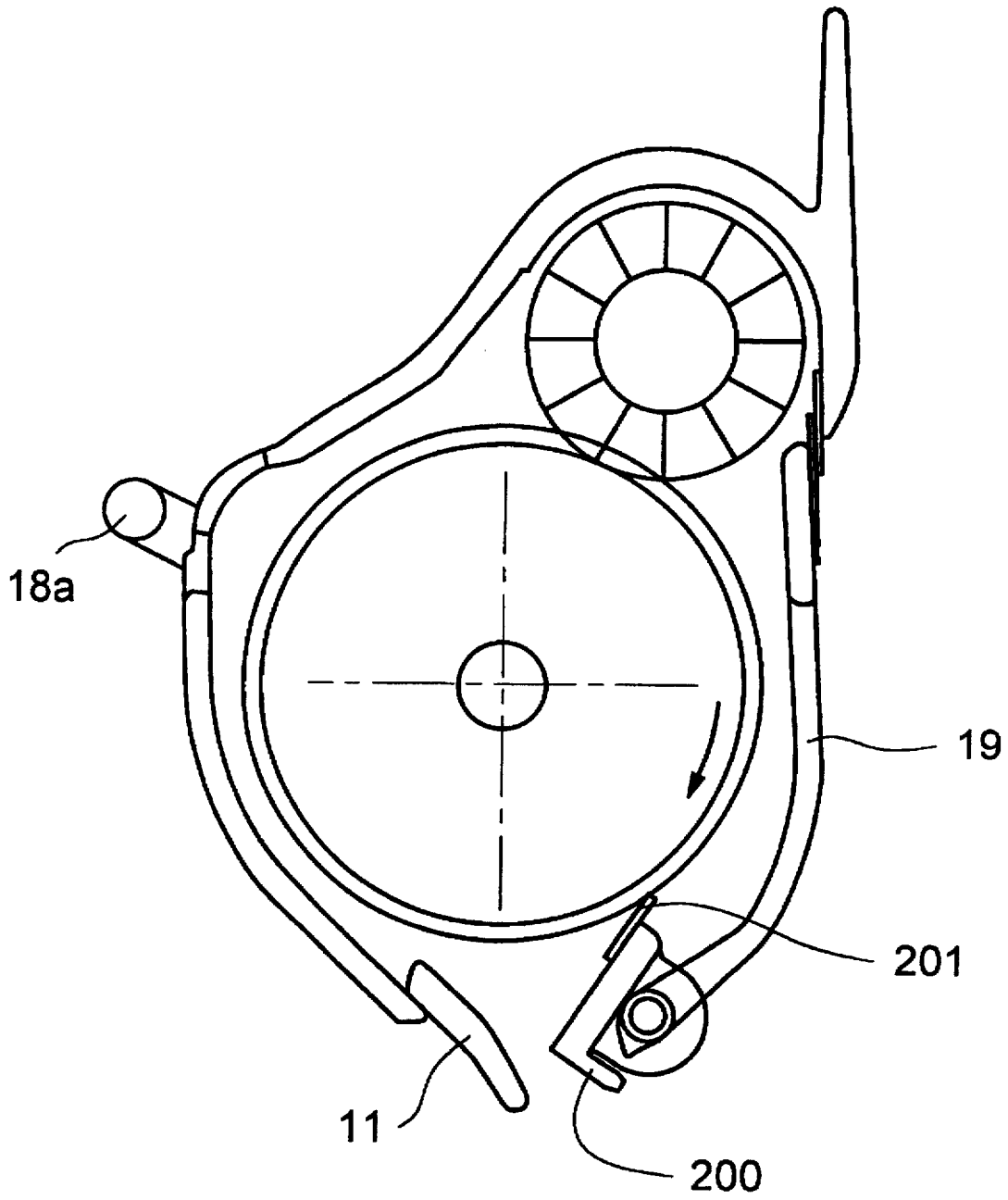
FIG. 11 is a section view of the photosensitive member unit with the shutter closed in a second embodiment.

A second embodiment of the present invention is described below with reference to FIGS. 9, 10, and 11.

Although a cleaning member (scraper 100) was provided on second shutter 19 in the previously described embodiment, a cleaning member (blade 201) is separately provided on second shutter 19 in the second embodiment described below.

A blade 201 makes contact with photosensitive drum 15 so as to clean the surface of photosensitive drum 15, and is held by adhesive or the like on blade support member 200. As shown in FIG. 9, blade support member 200 is rotatably supported on casing 11. Second shutter 19 is rotatably supported by a shaft bracket provided on blade support member 200. The rotational axis of second shutter 19 and the rotational axis of blade 200 are the same.

A torsion spring 151 is coiled around the rotating shaft of the second shutter 19, such that second shutter 19 and blade support member 200 are pulled against each other. On the other hand, a torsion spring 152 is also coiled around the rotating shaft of blade support member 200, such that said blade support member 200 is forced in a direction approaching photosensitive drum 15. The spring force of torsion spring 151 is set so as to be weaker than the spring force of torsion spring 152.

Accordingly, when an image forming operation is not occurring, i.e., when second shutter 19 covers photosensitive drum 15, (refer to FIG. 11) the leading edge of blade 201 makes contact with photosensitive drum 15 via the spring force of torsion spring 152 so as to clean photosensitive drum 15. As previously described in the preceding embodiment, when second shutter 19 opens in conjunction with the installation of developing unit 20 into the printer body, first, second shutter 19 opens to a predetermined angle, and blade support member 200 follows second shutter 19 and blade contact with photosensitive drum 15 is released (refer to FIG. 10). Conversely, when shutter 19 is closed from an open state, first, only second shutter 19 is closed to a predetermined angle, and thereafter, the blade support member follows and begins to close, and finally makes contact with photosensitive drum 15 (refer to FIG. 11).

The blade 201 of the second embodiment has materials and characteristics similar to the thin film 101 of the preceding embodiment. Furthermore, blade support member 200 fulfills a role equivalent to the thin plate 105 and flexible member 103 of the preceding embodiment.

Figure 12:
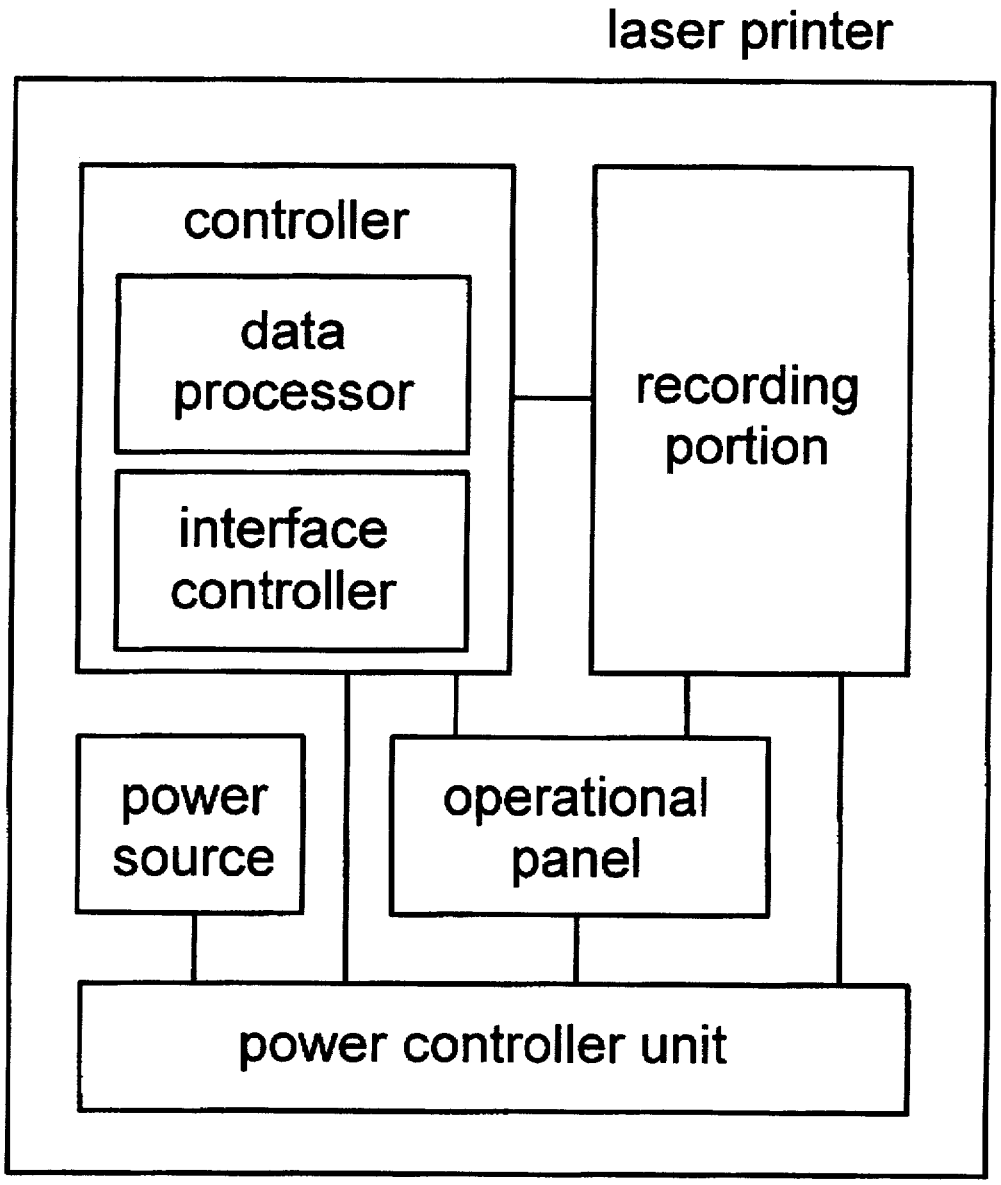
FIG. 12 is a block diagram of the laser printer control.

FIG. 12 is a control block diagram showing the control of the laser printer. The controller receives print data from an external host device, and subjects said data to processing a data processor. An interface controller within the aforesaid controller controls the data processor, recording portion, and operation panel. The operation panel is used to set and change the number of pages to be printed, print modes and the like. Cleaning of the photosensitive drum 15 in the present invention can be accomplished by using a test switch or the like provided on the operation panel (not illustrated).

The sequence for cleaning the photosensitive drum 15 by an operator is described below. First, developing device 20 is removed from the printer body, then photosensitive member unit 10 is removed. Then, the second shutter 19 of photosensitive member unit 10 is locked. That is, locking members 121 and 122 are engaged. Thereafter, only photosensitive member unit 10 is returned to the printer body, and a test printing is specified from a specific test switch on the operation panel. Not only test printing, but cleaning may be specified by a switch constructed so that the controller controls the recording portion to rotate the photosensitive drum 15 only for a predetermined time.

The thin film 101 of scraper 100 removed the foreign matter on the surface of photosensitive drum 15 in conjunction with the rotation of photosensitive drum 15. The removed foreign matter adheres to scraper 100 and is removed by the replacement of photosensitive member unit 10.

Since thin film 101 is pliable, the surface of photosensitive drum 15 is not excessively shaved. Since scraper 100 makes contact in a counter direction relative to the rotation direction of photosensitive drum 15 and scraper 100 is provided with a flexible member 103, there is an increased degree of contact of thin film 101 in conjunction with the rotation of photosensitive drum 15 so as to achieve excellent cleaning.

The present invention having the previously described construction assures normal image quality by cleaning the photosensitive drum when an operator determines cleaning is necessary.

Although photosensitive member unit 10 is removed from the printer body to accomplish the locking operation in the sequence described above, second shutter 19 may be locked without removal.

The present invention has been described in the above embodiments terms of an image forming apparatus that does not have a cleaning process, but the present invention may be adapted to image forming apparatus having a cleaning process so as to periodically clean the photosensitive drum.

As previously described, the present invention provides a cleaning member mounted in the vicinity of a shutter for protecting the photosensitive drum, wherein the cleaning member makes contact with the photosensitive drum only when an image forming process is not occurring. Accordingly, the overall apparatus is neither large nor complicated, and the photosensitive drum can be cleaned when an operator deems cleaning is necessary, thereby assuring image quality.

Although the present invention has been fully described by way of examples with reference to the accompanying drawings, it is to be noted that various changes and modifications will be apparent to those skilled in the art. Therefore, unless otherwise such changes and modification depart from the scope of the present invention, they should be construed as being included therein.

What is claimed is:

1. An image forming apparatus, comprising:

a photosensitive member;

a shutter covering a predetermined region of the photosensitive member during non-image forming time; and a cleaning member capable of cleaning the surface of the photosensitive member in accordance with rotation of the photosensitive member by making contact with the photosensitive member in conjunction with a covering operation of the shutter but which does not contact the photosensitive member when the shutter is open.

2. The image forming apparatus as claimed in claim 1, wherein the predetermined region of the photosensitive member is a region facing a developing unit.

3. The image forming apparatus as claimed in claim 1, wherein the cleaning member is fixed on the shutter.

4. The image forming apparatus as claimed in claim 1, wherein the cleaning member is provided separately from the shutter.

5. The image forming apparatus as claimed in claim 4, wherein the cleaning member comprises a blade which contacts the photosensitive member and a blade support member which supports the blade.

6. The image forming apparatus as claimed in claim 5, wherein the blade contacts the photosensitive member at approximately a 30 degree angle relative to a direction tangential to a surface of the photosensitive member.

7. The image forming apparatus as claimed in claim 5, wherein the blade support member is rotatable about an axis that is the same as a rotating axis of the shutter.

8. The image forming apparatus as claimed in claim 7, wherein the cleaning member is forced toward the photosensitive member by a spring provided on the rotating axis.

9. The image forming apparatus as claimed in claim 3, wherein the cleaning member provides a thin member contacting the photosensitive member.

10. The image forming apparatus as claimed in claim 9, wherein the thin member contacts the photosensitive member at approximately a 30 degree angle relative to a direction tangential to a surface of the photosensitive member.

11. The image forming apparatus as claimed in claim 9, wherein the thin member comprises a thin film which contacts the photosensitive member and a thin plate which supports the thin film.

12. The image forming apparatus as claimed in claim 9, wherein the cleaning member comprises a flexible member which supports the thin member.

13. The image forming apparatus as claimed in claim 9, wherein the flexible member supports the thin member only in a vicinity that is in contact with the photosensitive member.

14. The image forming apparatus as claimed in claim 1, further comprising:

lock means for locking the shutter covering the predetermined region of the photosensitive member.

15. An image forming apparatus, comprising:

a photosensitive member;

a developing unit which is removably installed in a body of the image forming apparatus and comprises a developing sleeve;

a shutter covering a region of the photosensitive member facing the developing sleeve when the developing unit is being removed from the body of the image forming apparatus; and a cleaning member capable of cleaning a surface of the photosensitive member in accordance with rotation of the photosensitive member by making contact with the photosensitive member in conjunction with a covering operation of the shutter but which does not contact the photosensitive member when the shutter is open.

16. The image forming apparatus as claimed in claim 15, wherein the shutter moves in order to cover the photosensitive member in response to removal of the developing unit.

17. The image forming apparatus as claimed in claim 15, wherein the cleaning member is fixed on the shutter.

18. The image forming apparatus as claimed in claim 17, wherein the cleaning member comprises a thin member which contacts the photosensitive member and a flexible member which supports the thin member.

19. The image forming apparatus as claimed in claim 18, wherein the flexible member supports the thin member only in a vicinity that is in contact with the photosensitive member.

20. The image forming apparatus as claimed in claim 15, further comprising:

a controller which makes the photosensitive member rotate when the developing unit is removed.

21. An image forming apparatus, comprising:

a photosensitive unit which is removably installed in a body of the image forming apparatus and comprises a photosensitive member;

a developing unit which is removably installed in the body of the image forming apparatus and comprises a developing sleeve;

a shutter provided on the photosensitive unit, the shutter covers a region of the photosensitive member facing the developing sleeve when the developing unit is being removed from the body of the image forming apparatus; and a cleaning member capable of cleaning a surface of the photosensitive member in accordance with rotation of the photosensitive member by making contact with the photosensitive member in conjunction with a covering operation of the shutter but which does not contact the photosensitive member when the shutter is open.

22. The image forming apparatus as claimed in claim 21, wherein the cleaning member is fixed on the shutter.

23. The image forming apparatus as claimed in claim 22, wherein the cleaning member comprises a thin member which contacts the photosensitive member and a flexible member which supports the thin member.

24. The image forming apparatus as claimed in claim 23, wherein the flexible member supports the thin member only in a vicinity that is in contact with the photosensitive member.

* * * * *